United States Patent [19]

Schiller

[11] Patent Number: 4,577,415

[45] Date of Patent: Mar. 25, 1986

[54] WINDOWED INDEXED CALIBRATED T-SQUARE AND PRECISION-LINED DRAFTING BOARD HAVING LINEAR EDGES

[76] Inventor: Saul Schiller, Brooklyn, N.Y.

[21] Appl. No.: 563,154

[22] Filed: Dec. 19, 1983

Related U.S. Application Data

[63] Continuation-in-part of Ser. No. 149,711, May 14, 1980, Pat. No. 4,422,245, which is a continuation-in-part of Ser. No. 28,198, Apr. 9, 1979.

[51] Int. Cl.[4] ..... B43L 7/00

[52] U.S. Cl. ..... 33/430; 33/437; 33/449

[58] Field of Search ..... 33/430, 433, 434, 436, 33/437, 443, 446, 447, 448, 449, 26, 32 R, 32 B, 42–44

[56] References Cited

U.S. PATENT DOCUMENTS

| | | | |
|---|---|---|---|
| 87,626 | 3/1969 | Bowly | 33/443 |
| 1,145,922 | 7/1915 | Rigaumont | 33/42 X |
| 1,340,623 | 5/1920 | Owens | 33/430 |
| 1,624,280 | 4/1927 | Rasmusen | 33/437 X |
| 1,792,393 | 2/1931 | Phillips | 33/42 |
| 2,058,091 | 10/1936 | Marsella et al. | 33/479 |
| 2,568,575 | 9/1951 | Wickman | 33/449 X |
| 2,923,061 | 2/1960 | Dolgorukov | 33/479 |
| 3,093,906 | 6/1963 | Cohara | 33/430 |

FOREIGN PATENT DOCUMENTS

| | | | |
|---|---|---|---|
| 404588 | 1/1943 | Italy | 33/468 |
| 23179 | of 1900 | United Kingdom | 33/479 |

*Primary Examiner*—Harry N. Haroian
*Attorney, Agent, or Firm*—William T. Hough

[57] ABSTRACT

In a preferred embodiment, there is provided a combination of a windowed indexed calibrated T-square and a precision-lined drafting board for use therewith for providing scaled drawings on drafting paper transparent to the drafting board's precision lines, the window being positioned in the helve head such that the index line positioned along a lower edge of the window is alignable with and positioned over the drafting board's precision lines when flat roller surfaces of spaced-apart x-axis aligning rollers on the helve head are pressed flushly against upright flat linearly-extending edge of the drafting board with the edge extending along the x-axis of the drafting board, with the roller surfaces being of broad width affording non-wobbling stable positioning of the blade of the T-square relative to an upper face of the drafting board when the T-square has the roller surfaces pressed flushly against the flat surfaces of the upright flat linearly-extending edge of the drafting board.

5 Claims, 9 Drawing Figures

WINDOWED INDEXED CALIBRATED T-SQUARE AND PRECISION-LINED DRAFTING BOARD HAVING LINEAR EDGES

This is a continuation-in-part of U.S. patent application Ser. No. 149,711 filed May 14, 1980 granted on Dec. 27, 1983 as U.S. Pat. No. 4,422,245 as a continuation-in-part of abandoned U.S. patent application No. 028,198 filed Apr. 9, 1979.

This invention, inclusive of the non-wobbling and rollers features utility of the above-noted patent, is directed additionally to a novel T-square and to a combination thereof with a novel drafting board.

BACKGROUND

While the invention of the above-noted patent utilizes a tripod arrangement of helve-head-mounted three spaced-apart roller surfaces positioned for bearing on an upright flat edge surface extending along an x-axis of a drafting board, the present invention while utilizing the same principal and arrangement also discloses another comparable embodiment, but together with additional problem-solving features directed to entirely different problems and difficulties facing a draftsman with the state of the art prior to the present invention.

Some of those problems and difficulties arise from the historical approach to drafting, using pin-pricks and the like on the paper on which drafting drawings are being applied, and making the drawing(s) and thereafter applying to the sheet a scale-data line of varying complexity. The complexity of ascertaining that the drawings during the drawing thereof remained in accord with proper and correct dimensional relationships of other portions of the drawing(s) required constant diligence and care, all contributing to increased difficulty in the drafting as well as requiring extended times periods of exacting work per drawing or portion thereof. Along with such problems of ascertaining that portions of drawings being drawn are of dimensions consistent with other portions already drawn, involve the precision use heretofore of a multiplicity of rules and the like to measure and compare distances and dimensions, particularly where fractional measurements and drawings-portions are required as a part of the entire drawing(s).

Also, heretofore, considered alone or in combination with the afore-mentioned problems or difficulties, simple or non-complex but precision-made drawing boards having inherent precision-engineered linearly extending x-axis and/or y-axis edges that may be relied on by a draftsman for use therewith of a T-square simply have not existed, although there have been various cumbersome and complicated devices affording a straight-guiding edge—such as the device of Beebe et al. U.S. Pat. No. 2,874,474 dated Feb. 24, 1959 that requires a specially-mounted plurity of brackets and guide-rail supported-thereon utilizable of solely a specific bearing-mechanism and drawing device disclosed in that patent as a substitute for the conventional T-square. Nothing along the nature noted-above of a simple to-scale drafting board has existed utilizable of any conventional T-square.

Considered alone, or together with the aforementioned problems, there has existed another momentous problem facing the draftsman over the ages, where scaled precision drawings are theretically required, with regard to T-squares. In particular, the open-throated T-square such as typically illustrated in the above-noted disclosure of above-noted U.S. Pat. No. 4,422,245 of which this is a continuation-in-part, over the years has come into wide use by draftsmen, but cannot be relied on for giving consistent measurement readings from time to time of intermittent reading or drawings based thereon, it has been discovered by the present inventor. Also, such open-throated T-squares have proven to be extremely fragile, readily subject to fracture of the open-throat structure of the helve head, fracturable or breaking as a result of a slight blow or bending or droping thereof accidentally, particularly in the environment of use by draftsmen active in industry in the making of tools, dies and the like where T-squares are typically metal to improve durability, but still not reliable for consistent nor accurate dimentions.

Also for the industrial draftsman who typically uses a sharppointed scriber for cutting into metal making scribing directly onto a metal surface, such metal objects rarely have a thickness comparable to that of a sheet of drafting paper, i.e. such metal objects have an upper surface elevated well-above the surface of the drafting board on which the metal object rests. This results in difficulty in maintaining the metal object in a non-shifting position as well as adding to difficulty of scribing on its upper metal surface.

OBJECTS OF THE INVENTION

Objects of the invention include the overcoming and/or avoiding of one or more of the problems and/or difficulties above-noted, by the creations of the present invention.

Another object is to obtain a novel T-square contributing to overcoming one or more of the above-noted problems and/or difficulties.

Another object is to obtain a novel drafting or scribing board contributing to overcoming one or more of the above-noted problems and/or difficulties.

Another object is to obtain above-noted novel T-square and novel drafting(scribing) board adapted to interact and be utilized beneficially together to overcome one or more of the above-noted problems and/or difficulties.

Other objects become apparent from the preceding and following disclosure.

One or more objects of the invention are obtained by the invention described herein, as typically illustrated in the accompanying drawings that are intended to improve understanding but not to unduly limit the scope thereof.

BROAD DESCRIPTION

One embodiment of the invention may be broadly described as a drafting(scribing) T-square with its blade and helve head unitaritly and rigidly connected thereto with the conventional blade straight-edge extending along a first longitudinal axis of the blade, of which the improvement includes a special arrangement of two or more particular rollers mounted on the helve head, and the helve head including a window therein structured to be a closed-window, as opposed to an open-throated helve head, together with having or carrying a legibly visible index mark particularly positioned. The rollers are each inclusive of flat roller surfaces and are mounted on a bottom of the helve head such that when the T-square is in use with a drafting board, the roller surfaces are flushly pressable against upright flat surfaces of the lower and/or side edge of the drafting board, the rollers being mounted aligned along a linear axis that during use parallels an x-axis of the drafting board. The width(s) of the flat roller surfaces are sufficiently large to be the equivalent of spaced-apart rollers of the tri-pod arrangement of the parent above-noted U.S. Pat. No. 4,422,245 with the roller flat surfaces extending width-wise in a direction substantially transverse to the longitudinal axis of the blade and to the longitudinal axis of the base of the helve head at the locations that the roller surfaces in use would be pressing against the upright surface of the bottom edge of the drafting board, such that the T-square blade is stably maintained at a consistent position relative to the upper face of the drafting board and devoid of wobbling upwardly and downwardly when in use. The windowed helve head-structure not only provides desired and improved strength to the helve head and its connecting structure to its blade, but more importantly to the draftsman, it has been discovered, prevents variations from occuring from true dimensions and from prior measurements, as compared to open-throated T-squares which, the inventor has discovered, change markedly reponsive to minor changes in temperature of the room, particularly with metal T-squares, as a result of their respective coefficients of expansion, whatever material the open-throated T-square may be made of. The angular shape of the open-throated T-squares provide a leverage structure between its blade and the aligning portions of the helve head, such that expansion as temperature rises, or contraction as temperature lowers in the room, causes the x-axis portion of the helve head to deviate away from a ninety-degree relationship to the y-axis of the straight edge of the blade of the T-square. With the windowed helve head of the present invention, attaching structure on each of both sides of the window attaching to the blade serve to off-set and dampen distorting tendences on each other and to maintain a true and correct ninety-degree relationship above-noted at all times irrespective of changes in room temperature.

Additionally, the above-noted particularly-positioned legibly visible index mark particularly positioned as above-noted could not reflect accurate readings on an open-throated T-square for reasons stated-above. Accordingly, the inventor now has produced the first T-square having an aligned legibly visible index line aligned with particularly and specifically the straight-edge of the blade, where for this invention it is required that the index line be positioned at or near an edge of the window of this invention's windowed helve head making possible easy adjusting of the T-square relative left or right adjustments of the blade's straight edge when making drawings to scale relative to calibrated points and/or indicia carried along the x-axis of a drawing board and/or along the y-axis of a drawing board, or relative to calibrated (i.e. measured) spaced-apart lines of a lines drafting board or graph paper. Accordingly, it should be noted that there is an important relationship between the novel use of such index mark in juxtaposition to the window, and the windowed helve head devoid of problems of open-throated helve-head T-squares.

In one preferred combination, the invention includes the above-noted drafting board having its upper flat face and the upright flat edge-surface extending along an imaginary x-axis of the drafting(scribing) board.

Also, preferably the drafting board has a plurality of legibly visibly-discernible parallel linear lines thereon evenly-spaced from one-another extending along an imaginary y-axis of the board, at a right angle to the imaginary x-axis of the board, and the board has a further plurality of other legibly visibly-discernible parallel linear lines thereon evenly-spaced from one-another extending perpendicularly to the first plurality of lines, extending i.e. along an imaginary x-axis of the board and perpendicular to an imaginary y-axis of the board. That is to say, there are intersecting graph lines perpendicular to one-another, on the face of the board; and equivalent to this, included within such statement of the invention is mechanism for mounting such graph paper in an aligned position on the upper face of the drafting board.

In another preferred embodiment of the invention, the scribing board (drafting board) has a second upright edge extending along the imaginary y-axis substantially parallel thereto and to above-noted graph lines that extend along the y-axis, noting that the upright edge is naturally flat the same as stated for the first upright edge of the board. Accordingly, the T-square of the invention may be used along the y-axis edge of the board also. Obviously such positioned second upright flat edge of the board is perpendicular to the x-axis of the board of this invention.

Allowing calibrated drawings to be made with ease on the drafting paper or metal being scribed, preferably the helve head's upper surface has one or more, preferably a plurality of calibration mark(s) and/or indicia associated therewith spaced a predetermined calibrated distance laterally-transversly along the longitudinal axis of the helve head, i.e. transverse to the longitudinal axis of the straight edge of the blade.

In another preferred embodiment, particularly for use by a scribing draftsman who scribes with a scriber and its cutting point, directly on an upper surface of a metal object, there is provided a height-adjustable straight-edge along a base of the board, along the imaginary x-axis thereof, preferably having both upper and lower straight edges; the lower straight edge functions in-part as an extension of the board's base upright flat edge, for the use of a T-square thereagainst, whereas the upper straight edge serves to position a straight side of a metal or other object of which an upper surface is to be scribed or drawn upon. Preferably there is a like height-adjustable straight-edge along a side upper surface of the board, extending along the imaginary y-axis of the scribing (drafting) board. Accordingly, the ease and speed and also accuracy of the work of the draftsman or scriber is substantially enhanced, increasing quality of work and reduction of operating costs. Preferably such structures and features are included also as a part of the overal inventive combination previously described above. Typical threaded shaft and plurality of nuts are provided for each of at-least two or more mounting positions for fastening to the upper surface of the board, the number of nuts below and/or above the adjustable-height straight edge resulting in the desired height, the number being alterable manually, for each position, as typically shown in the drawings. This adjustable straight edge preferably is in the shape of a right angle, providing both a bottom straight-edge and a side-straight-edge, and more preferably each of the bottom and side straight-edges carry calibration marks and corresponding indicia therealong, further facilitating the work of the draftsman or scriber.

The invention may be better understood by making reference to the following figures.

THE FIGURES

FIG. 1 illustrates in elevation plan view, one of the preferred combinations of the present invention, namely the drafting board having precision straight or linear bottom and side edges and having precision-aligned chart or graph intersecting lines along the x and y axes on the surface of the board shown in part-view (partial cut-away), shown with a drafting paper of transparent nature mounted thereon with initial drawing marks thereon; and as a part of the illustrated combination also shown in elevation plan in-part view is a preferred T-square above-described.

FIG. 2 illustrates in elevation plan in-part view a bottom face of the same T-square, also showing the spaced-apart rollers mounted on the bottom face.

FIG. 3 illutrates an end-view of the same T-square of FIGS. 1 and 2, as taken along line 3—3 of FIG. 2.

DETAILED DESCRIPTION

In the several above-noted figures, where differing embodiments of the same elements or features thereof have been indexed by indicia, similar indicia are utilized to facilitate understanding and comparison. Once an element has been described for one figure, the description is not repeated for other figures, unless for purposes of clarity or further comment or the like.

Figure 1:
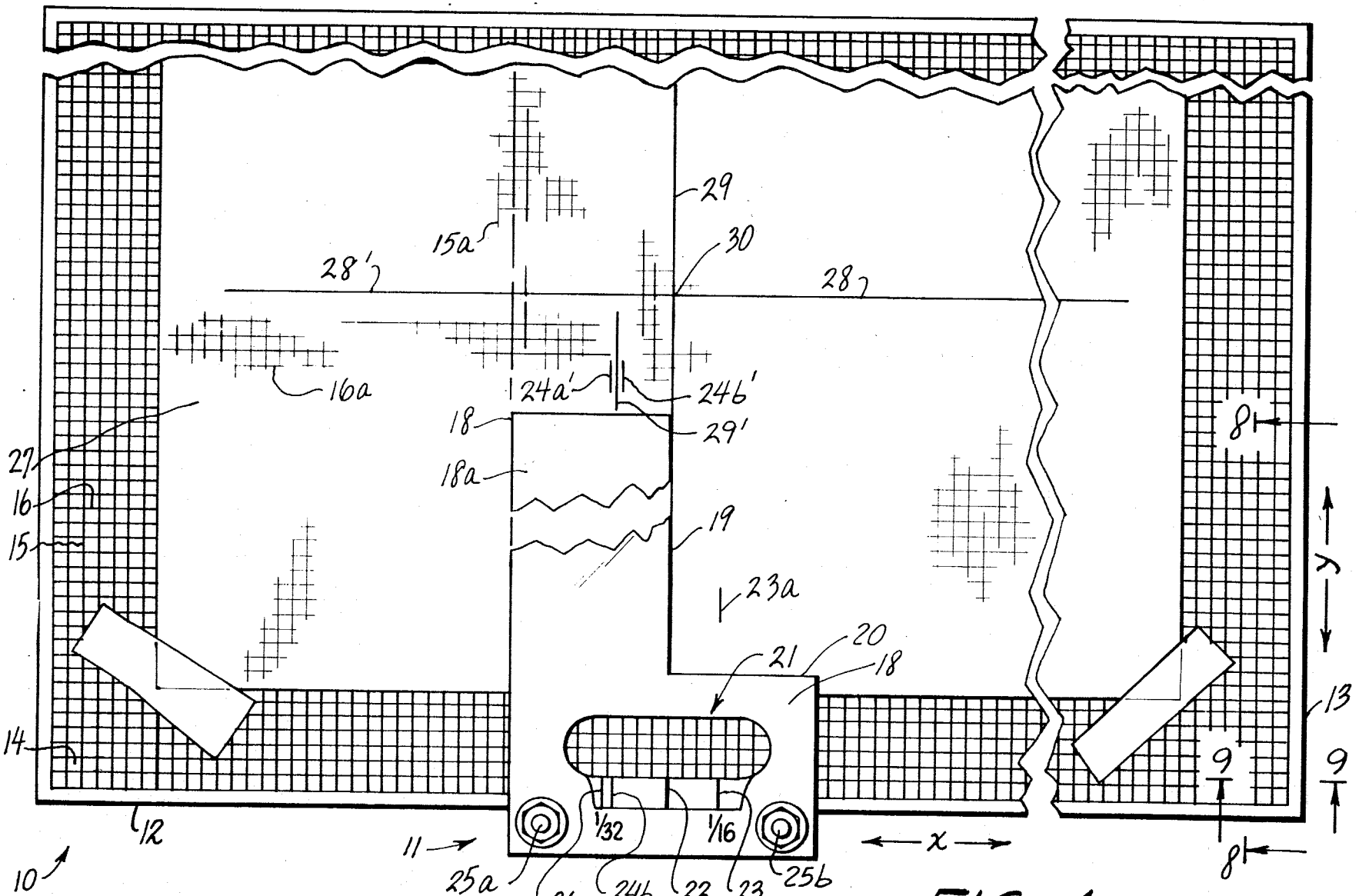
Figure 2:
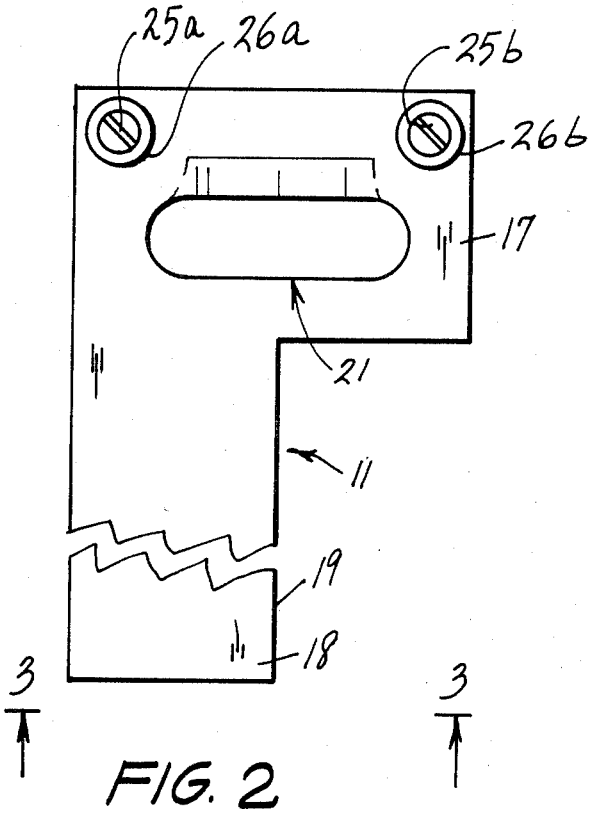
Figure 3:
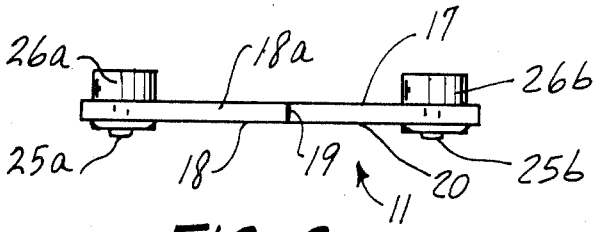
Figure 8:
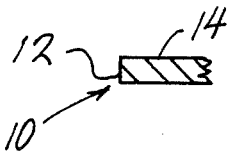
FIG. 8 illustrates a view taken along line 8—8 of FIG. 1.
Figure 9:
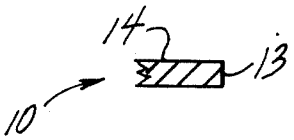
FIG. 9 illustrates a view taken along line 9—9 of the FIG. 1.

Accordingly, FIG. 1 illustrates a drafting or scribing board 10 having operatively placed thereon the T-square 11. The drafting board 10 has bottom precision-straight edge 12 along the bottom side of the board which bottom side corresponds to an x-axis of the board, and has side precision-straight edge 13 along the right side of the board which right side corresponds to a y-axis of the board. It is to be understood that preferably and most likely both the top and bottom, and both the right and left edges would all be precision straight edges. The drafting board's upper face 14 includes intersecting plurality of lines 16 extending each along an imaginary x-axis of the board, and intersecting plurality of lines 15 extending each along an imaginary y-axis of the board, the lines 15 intersecting with the lines 16 at right-angles, forming a chart or graph on the upper face 14. FIGS. 8 and 9 show sides 12 and 13. Of the T-square 11, its lower flat face 17 is shown in FIG. 3, and its upper flat face 18 is shown in FIGS. 3 also. Face 17 is also shown in the bottom view of FIG. 2, and face 18 is also shown in top view of FIG. 1, for the FIG. 1 helve head 20. The blade's straight edge 19 of blade 18*a*, straight edge 19 also being shown in FIG. 3, and also in FIG. 2. The helve head 20 includes the closed-throated window 21, having index mark 22 aligned with the straight edge 19. Also along the bottom-edge of the closed-throated window 21 is mark 23 and indicia 1/16 thereof, identifying 1/16 of an inch where the distance between adjacent parallel lines 15 is ⅛ inch, whereby on the drafting paper 27 mounted on upper surface 14 of the board, the distance measured from scribed line 29 of zero-point 30 corresponding to and aligned with index mark 22, is 7/16 of an inch—i.e. three squares (each ⅛ or 2/16 inch) plus 1/16 inch, a mark being made at the helve-head mark 23 followed by moving the mark 22 thereto and drawing a line along straight-edge 19 to produce the scribed line 29. At any line 15, the index 22 may be aligned therewith in order to thereby adjust the distance of the line 15 near where drawing is to be made to be next to the mark 23. Thereby an upright or line 23*a* may be drawn with precision measurement at any point on the paper 27. Likewise, mark 24*a* and mark 24*b* are exactly 1/32 (half of 1/16) inch on either side of a line 15 when the index mark 22 is aligned with a line 15, whereby in the manner described-above, drawings may be measured to scale and applied directly in-scale to the paper 27 as typically shown by drawing lines 24*a*′ and 24*b*′ on opposite sides of a line 29′ that corresponds in position to a line 15 directly thereunder on the face 14 of the board. Illustrated lines 15*a* and 16*a* represent lines 15 and 16 as they would be discernibly seen through the transparent paper 27. Point 30 represent a point of right-angle intersection of a draftsman's drawn lines 28 and 29, line 28 being a horizontal line drawn on the drafting paper 27 drawn above one of the lines 16, and line 29 being a vertical (y-axis) line drawn above one of the lines 15, lines 28 and 29 representing a zero point on the y-axis and on the x-axis respectively. Thus, lineportion 29′ is below the zero-point 30 and line 29 is above it. Likewise line 28 is a "plus" line portion to the right of the zero point 30, and line-portion 28′ is a "negative" line portion to the left of the zero point 30.

Figure 5:
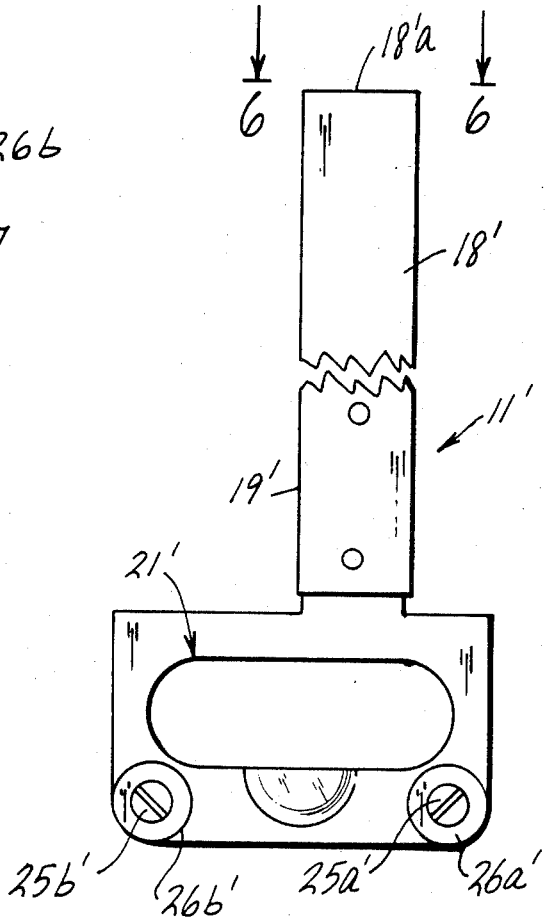
FIG. 5 illustrates an elevation plan view of the bottom face of the same T-square illustrated in FIG. 4, in an in-part cut-away view, such also showing the spaced-apart rollers mounted thereon on that bottom face of the T-square.
Figure 6:
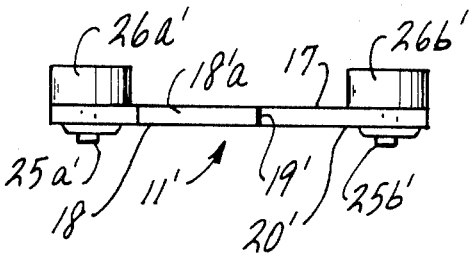
FIG. 6 illustrates an end-view of the T-square as taken along line 6—6 of FIG. 5, of the same T-square as shown in FIG. 5.
Figure 4:
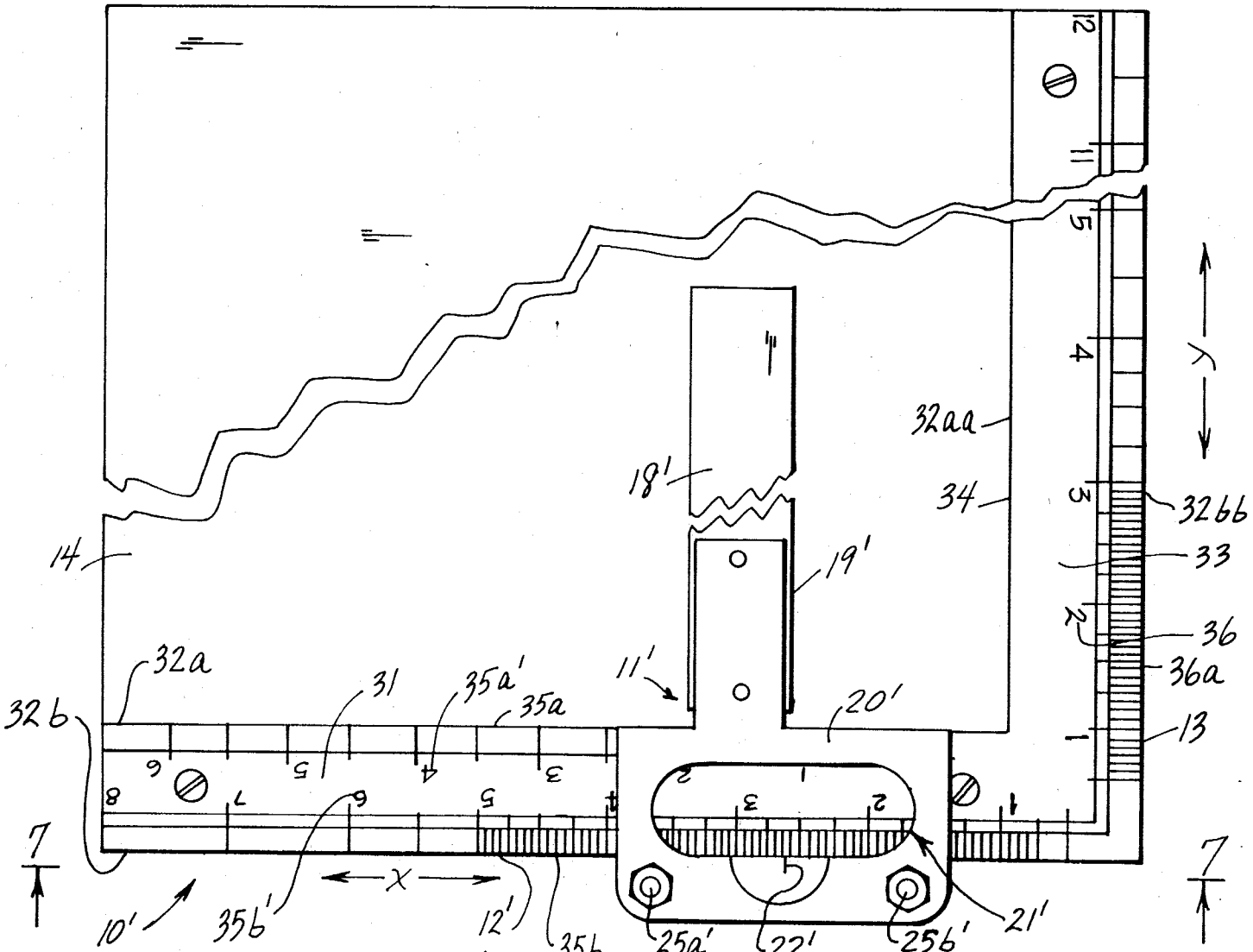
FIG. 4 illustrates a diffenent embodiment of each of another preferred drafting(scribing) board and of another preferred metal T-square in combination therewith, both shown in elevation plan views with partial cut-aways, also showing the preferred base and side elevation-adjustable straight edges mounted on the board as an integral part thereof.

In the embodiment of FIGS. 4, 5 and 6, and also 7, aside from corresponding elements and indicia already identified, the T-square 11′ is preferably metal in composition, providing a sturdy instrument not subject to breakage nor fracture, together with being reliable arizing from the double-neck construction previously described, also with the inventive window and index mark 22′ which window 21′ and index mark 22′ are properly positioned such that when in use as illustrated in FIG. 4, the index mark 22′ may be moved and registered against any of indicia of the outer-most scale shown on base/-horizontal x-axis-bar 31 as scale calibrations 35*b* and indicia 35*b*′ thereof for corresponding alignment of straight edge 19′. The straight edge 19′ may also be registered with the calibrations 35*b* and indicia thereof for that straight-edge 32*a*, both rule or bar 31 edges 32*a* and 32*b* being straight edges, and likewise the edges 32*aa* and 32*bb* of the y-axis bar/rule being straight edges and having corresponding outside calibrations and indicia therealong and inside calibrations and indicia therealong as shown, making reference to FIGS. 4 and 7. The y-axis bar/rule is identified as bar 34, with indicia 36 and calibrations 36*a*.

In each of FIGS. 2 and 3 and FIGS. 5 and 6, there will be noted the roller-mounting axes 25*a*, 25*b*, 25*a*′ and 25*b'*, and the upright flat roller surfaces 26*a*, 26*b*, 26*a'* and 26*b'*.

Figure 7:
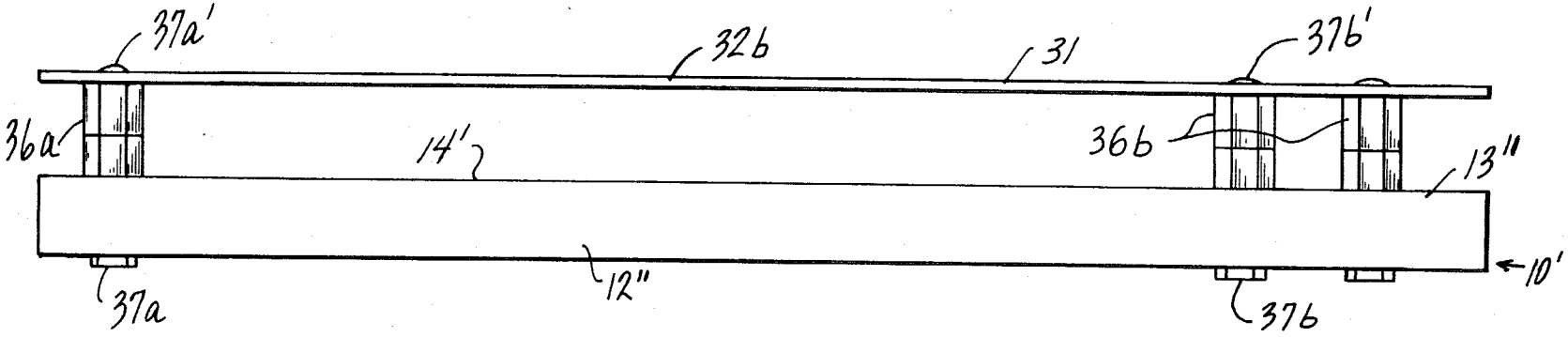
FIG. 7 illustrates a side view of the scribing board of FIG. 4, minus any showing of the T-square, as it would appear if taken along line 7—7 of FIG. 4.

FIG. 7 illustrates a side view of solely the drafting (scribing) board 10' as taken along line 7—7, showing the bar/rule 31 mounted and raised to an elevated-state and position as shown. The male-threaded bolts and nuts, are illustrated as bolts 37*a'* and 37*b'* and nuts 37*a* and 36*a*, and nuts 37*b* and 36*b*. For a lower height, the bolts may have some or all of the nuts 36*a* and 36*b* mounted above the bar/rule 31, for example. The same is true for the bar 34 and its mounting bolts and nuts. FIGS. 8 and 9 respectively show in-part views in cross-section, of the front and side straight edges 12 and 13 of the board 10.

It will be observed in FIG. 7 that the board faces 12' and 13' are vertical flat faces and constitute straight-edges. The same is true for the board faces 12 and 13 of FIG. 1.

It is within the scope of the invention to make variations and modifications within ordinary skill of an artisan in this field, and to make substitutions of equivalents for various elements thereof.

I claim:

1. A scribing T-square consisting essentially of a blade having a straight edge along a first longitudinal axis of the blade, and a helve head unitary and rigidly connected with a proximal end of the blade, said helve head having an elongated portion elongated along a second longitudinal axis extending substantially at right angles to said straight. edge, and at-least two spaced-apart flat-bottomed rollers each of predetermined roller-surfaces of widths sufficiently wide to jointly maintain said blade at a constant and parallel relationship with a scribing surface when the roller-surfaces are pressed against a first upright flat edge-surface of a flat scribing board, said widths being sufficiently wide to be the equivalent of spaced-apart rollers of a tripod arrangement, said rollers being mounted in series with one-another substantially aligned with said second longitudinal axis and axes of the rollers being positioned such that said roller-surfaces are rollable flushly against an upright flat edge-surface of a scribing board having an upper flat face and such that said roller-surfaces are rollable along said second longitudinal axis when pressed against the upper flat edge-surface of a scribing board, mounted on roller-axes and extending downwardly from a lower surface of said elongated portion and extending substantially transversely to said first and second longitudinal axes whereby the scribing T-square is prevented from wobbling on the helve head and the blade relative to the upper flat face of a scribing board when in use therewith, and said helve head being structured and shaped to form a closed-throated window and said helve head having an upper surface embodying the closed-throated window, and said location being spaced-across from a lower end of the straight edge and aligned therewith, said roller-axes being mounted on said elongated portion and extending downwardly relative to a lower surface of said elongated portion, mount-positions of said roller-axes being at locations positioned below said closed-throated window, said scribing board having said upper flat face and having said upright flat edge-surface extending along an imaginary x-axis of the scribing board, and said scribing board having a second upright edge extending along an imaginary y-axis, substantially at a right angle to said imaginary x-axis, and additionally including a first elongated member having a flat upper-surface mounted adjustably along said imaginary x-axis substantially parallel to said first upright edge, and having a top-edge toward a body-portion of the scribing board, that is linear and parallel to said first upright edge, and a first elongated member-mounting means for adjusting the first elongated member intermittently to different predetermined heights above an upper surface of the scribing board and for intermittently locking the first elongated member at any one of said different predetermined heights.

2. A scribing T-square of claim 1, including a second elongated member having a flat upper-surace mounted adjustably along said imaginary y-axis substantially parallel to said second upright edge and having a top-edge toward a body-portion of the scribing board, that is linear and parallel to said second upright edge, and a second elongated member-mounting means for adjusting the second elongated member intermittently to different predetermined heights above an upper surface of the scribing board and for intermittently locking the first elongated member at any one of said different predetermined heights.

3. A scribing T-square consisting essentially of a blade having a straight edge along a first longitudinal axis of the blade and a helve head unitary and rigidly connected with a proximal end of the blade, said helve head having an elongated portion elongated along a second longitudinal axis extending substantially at right angles to said straight edge, and at-least two spaced-apart flat-bottomed rollers each of predetermined roller-surfaces of widths sufficiently wide to jointly maintain said blade at a constant and parallel relationship with a scribing surface when the roller-surfaces are pressed against a first upright flat edge-surface of a flat scribing board, said widths being sufficiently wide to be the equivalent of spaced-apart rollers of a tripod arrangement, said rollers being mounted in series with one-another substantially aligned with said second longitudinal axis and axes of the rollers being positioned such that said roller-surfaces are rollable flushly against an upright flat edge-surface of a scribing board having an upper flat face and such that said roller-surfaces are rollable along said second longitudinal axis when pressed against the upper flat edge-surface of a scribing board, mounted on roller-axes and extending downwardly from a lower surface of said elongated portion and extending substantially transversely to said first and second longitudinal axes whereby the scribing T-square is prevented from wobbling on the helve head and the blade relative to the upper flat face of a scribing board when in use therewith, and said helve head being structured and shaped to form a closed-throated window and said helve head having an upper surface embodying the closed-throated window, and said location being spaced-across from a lower end of the straight edge and aligned therewith, said rolleraxis being mounted on said elongated portion, mount-positions of said roller-axis being at locations positioned below said closed-throated window, said scribing board having said upper flat face and having said upright flat edge-surface extending along an an imaginary x-axis of the scribing board, and additionally including a first elongated member having a flat upper-surface mounted adjustably along said imaginary x-axis substantially parallel to said upright flat edge-surface and having a top-edge toward a body-portion of the scribing board, that is linear and parallel to said first upright edge, and a first elongated member-mounting means for adjusting the first elongated member intermittently to different predetermined heights above an upper surface of the scribing board and for intermittently locking the first elongated member at any of said different predetermined heights.

4. A scribing board having an upper flat face and an upright flat edge-surface extending along an imaginary x-axis of the scribing board as a first upright surface, and a second upright flat surface extending along an imaginary y-axis of the scribing board at a right angle to said imaginary x-axis, and a first elongated member having a flat upper-surface mounted adjustably along said imaginary x-axis substantially parallel to said first upright flat surface and having a top-edge toward a body-portion of the scribing board, said top edge being linear and parallel to said first upright surface, and a first elongated member-mounting means for adjusting the first elongated member intermittently to different predetermined heights above an upper surface of the scribing board and for intermittently locking the first elongated member at any one of said different predetermined heights.

5. A scribing board of claim 4, including a second elongated member having a flat upper surface mounted adjustably along said imaginary y-axis substantially parallel to said second upright edge and having a top-edge toward a body-portion of the scribing board, the top-edge of the second elongated member being linear and parallel to said second upright flat surface, and a second elongated member-mounting means for adjusting the second elongated member intermittently to different predetermined heights above an upper surface of the scribing board and for intermittently locking the first elongated member at any one of said different predetermined heights.

* * * * *